US006095436A

United States Patent [19]

Seegers et al.

[11] Patent Number: 6,095,436

[45] Date of Patent: Aug. 1, 2000

[54] LOW-COST AIR-BLAST ATOMIZING NOZZLE

[75] Inventors: Bryan J. Seegers, Phoenix; Jonathan A. Sherbeck, Tempe; Robert S. Murray, Phoenix, all of Ariz.

[73] Assignee: M-Dot Inc., Phoenix, Ariz.

[21] Appl. No.: 09/207,020

[22] Filed: Dec. 7, 1998

[51] Int. Cl.[7] ..... B05B 7/10

[52] U.S. Cl. ..... 239/403; 239/424; 239/468; 239/590.5; 239/600

[58] Field of Search ..... 239/397, 403, 239/419, 419.3, 423, 424, 417.3, 463, 468, 471, 590.5, 600; 60/737, 740

[56] References Cited

U.S. PATENT DOCUMENTS

| | | | |
|---|---|---|---|
| 2,907,529 | 10/1959 | Ghelfi | 239/424 X |
| 3,337,135 | 8/1967 | Blakely et al. | 239/403 X |
| 3,799,449 | 3/1974 | Gardner | 239/403 |
| 3,980,233 | 9/1976 | Simmons et al. | 239/424 X |
| 4,698,014 | 10/1987 | Grethe et al. | 239/403 X |
| 4,773,596 | 9/1988 | Wright et al. | 239/403 X |
| 4,946,105 | 8/1990 | Pane, Jr. et al. | 239/403 X |
| 5,044,559 | 9/1991 | Russell et al. | 239/424 X |

*Primary Examiner*—Andres Kashnikow
*Assistant Examiner*—Steven J. Ganey
*Attorney, Agent, or Firm*—Warren F.B. Lindsley; Frank J. McGue

[57] ABSTRACT

A low-cost atomizing nozzle suitable for use with viscous fuels and other liquids in high and low temperature environments. The nozzle structure comprises a cylindrical hollow tube forming a venturi having inlet and outlet ends, a cylindrical hollow barrel and a fuel catheter. The nozzle provides maximum surface contact between the liquid fuel and atomizing air streams.

7 Claims, 1 Drawing Sheet

LOW-COST AIR-BLAST ATOMIZING NOZZLE

BACKGROUND OF THE INVENTION

Air-blast atomizing nozzles are employed for the atomization of liquid fuels into minute droplets in an air atmosphere suitable for rapid and efficient combustion. The essential characteristics of such an atomizing nozzle include the following:

1) Maximum surface contact between the liquid fuel and the atomizing air stream; and 2. Maximum relative velocity of the air relative to the fuel.

These characteristics are commonly met in state of the art atomizers by spreading the fuel in a thin layer or continuous sheet that is exposed, preferably on both sides, to the air blast. For maximum exposure of the fuel to the air the sheet should be as thin as possible, using any of a number of known techniques.

The present invention employs a combination of such prior art techniques in a novel mechanical structure that is especially simple in form and readily manufacturable at low cost. Its structural simplicity is particularly suitable for nozzles of very small dimensions but is equally useful for larger nozzles.

SUMMARY OF THE INVENTION

In accordance with the invention claimed, a novel atomizing nozzle is provided for use in atomizing liquid fuels.

It is, therefore, one object of this invention to provide a novel atomizer structure.

Another object of this invention is to provide such an atomizer structure in a simple and inexpensive form comprising a minimum number of components.

A further object of this invention is to provide such an atomizer structure comprising components which are geometrically simple and may be formed using straight-forward machining processes.

A still further object of this invention is to provide such an atomizer structure in a form that is self-aligning and requires no special fixtures for assembly.

A still further object of this invention is to provide in such an atomizer structure means for prevention of coking of the fuel in its entry catheter under conditions of elevated temperatures.

A still further object of this invention is to provide such an atomizer structure in a form that is inherently efficient in operation.

A still further object of this invention is to obtain such efficient operation through the application of known principles including: the tangential introduction of fuel upon an extended cylindrical pre-filming surface with centrifugal forces distributing the fuel into a thin layer; the incorporation of a vena contracta at the entry of the central air blast, thereby creating a recirculation torus which aids in the spreading and shearing of the liquid fuel into a fine spray; and the incorporation of an outer air blast in addition to said central air blast so that both surfaces of the fuel film are exposed to high velocity air as the film leaves the cylindrical surface.

A still further object of this invention is to incorporate in such an atomizer structure a fuel metering catheter in a form that is readily removable for cleaning with the air of a catheter guide tube that also affords protection of the catheter against elevated temperatures.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
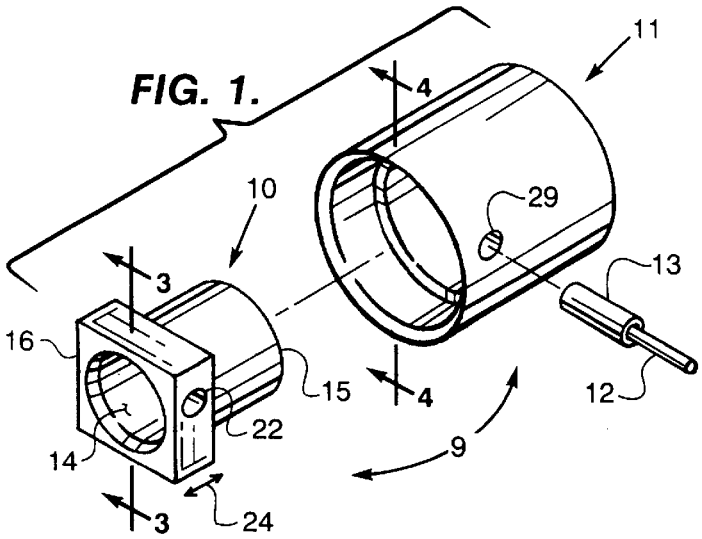
FIG. 1 is an exploded perspective view of the atomizing nozzle of the invention.
Figure 2:
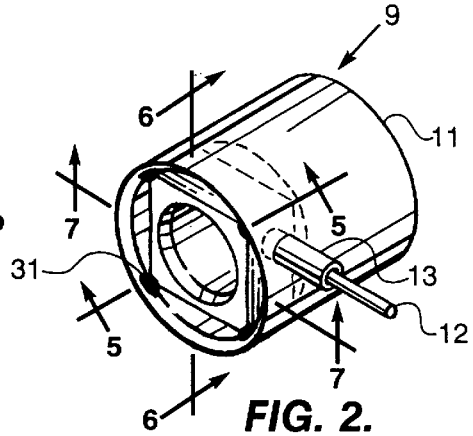
FIG. 2 is a perspective view of the fully assembled atomizing nozzle of the invention

Referring more particularly to the drawing by characters of reference, FIG. 1 discloses the constituent parts of the atomizing nozzle 9 of the invention comprising a venturi 10, a barrel 11, a fuel catheter 12 and a catheter heat shield or guide tube 13. All four parts are preferably made of stainless steel or other high temperature alloy.

Figure 3:
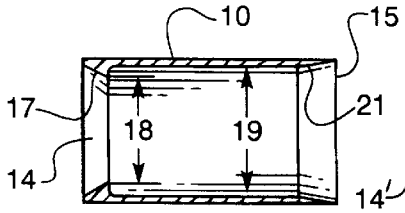
FIG. 3 is a cross-sectional view of the venturi or central element of the atomizing nozzle of the invention taken along line 3—3 of FIG. 1.
Figure 4:
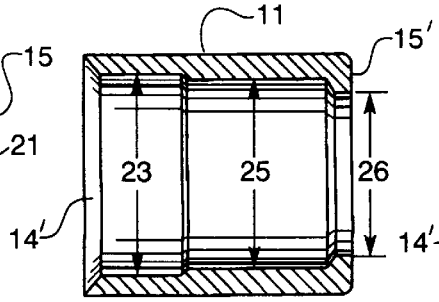
FIG. 4 is a cross-sectional view of the barrel or outer shell of the atomizing nozzle of the invention taken along line 4—4 of FIG. 1.

The venturi 10, as shown in FIGS. 1 and 3, has an inlet end 14 and an exhaust end 15. It has the general form of a hollow cylinder with a square retainer head 16 at its inlet end 14. The cylindrical interior extends from exhaust end 15 to inlet end 14 where a vena contracta is formed by a radially inwardly extending annular ridge 17. From the inlet end 14 of venturi 10, the ridge 17 slopes inwardly and rearwardly to its minimum diameter 18 where it terminates abruptly, falling back perpendicularly to the full diameter 19 of the main portion of the hollow venturi interior. At the exhaust end 15, the venturi is terminated with an interior bevel 21 which causes the interior cylindrical surface to expand at its termination to the outside diameter of the venturi. A cylindrical bore 22 through a corner of retainer head 16, running parallel with a face of retainer head 16, opens into the cylindrical interior of venturi 10 in a direction tangential to the interior cylindrical surface. The bore 22 is sized to receive the catheter guide tube 13.

Figure 5:
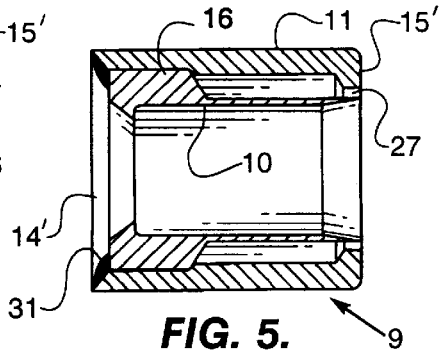
FIG. 5 is a cross-sectional view of the fully assembled atomizing nozzle of the invention taken along line 5—5 of FIG. 2.

The barrel 11 as shown in FIGS. 1, 2, 4 and 5 comprises a hollow cylinder, with an inlet end 14' and an exhaust end 15'. The interior diameter 23 at the inlet end 14' is just large enough to accommodate the diagonal dimension of the square retainer head 16 of venturi 10. The cylindrical surface corresponding with the diameter 23 extends longitudinally a distance equal to the thickness 24 of retainer head 16 and occupying roughly a third of the total length of barrel 11. The inside diameter 25 of the remaining portion of barrel 11 is slightly smaller, being sized to prevent entry of retainer head 16. At the inlet end 14', the edge of barrel 11 is beveled inwardly. At the outlet end the barrel 11 is flared inwardly to a somewhat smaller exhaust diameter 26. As shown in FIG. 5, when the venturi 10 is installed in the barrel 11, the corners of retainer head 16 rest upon the shoulder formed at the junction of the two diameters, 23 and 25 of barrel 11. Also, as shown in FIG. 5, the inside diameter 26 at the flared exhaust end of barrel 11 is seen to be somewhat greater than the outside diameter of venturi 10 so that an airway 27 remains between the inwardly flared exhaust end of barrel 11 and the outside surface of the exhaust end of venturi 10.

As shown in FIG. 1, the catheter heat shield or guide tube 13 fits through bore 22 of venturi 10 and through an aligned bore 29 of barrel 11. The fuel catheter 12 extends through the guide tube 13 into the interior of venturi 10 as discussed earlier.

The assembly of the atomizing nozzle of the invention proceeds as follows: venturi 10 is first installed in barrel 11 by inserting the exhaust end 15 of venturi 10 into the inlet end 14' of barrel 11. When the four corners of retainer head 16 are pressed against the shoulder formed at the junction of the two inside diameters of barrel 11 the venturi 10 and the barrel 11 are self-aligned axially and longitudinally. With this condition achieved and sustained, the venturi is then rotated to align bore 22 of the venturi 10 with bore 29 of barrel 11. The guide tube 13 and the catheter 12 are then installed as discussed earlier. A final step in the assembly comprises the welding or brazing of the four corners of head 16 to the adjacent surfaces of barrel 11 as indicated by the weldments 31 shown in FIGS. 2 and 5.

Figure 6:
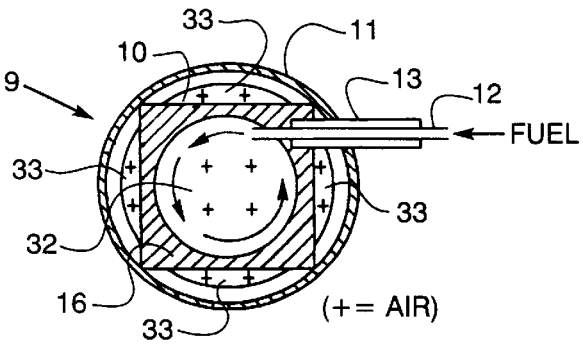
FIG. 6 is a cross-sectional view of the atomizing nozzle of the invention taken along line 6—6 of FIG. 2 showing air and fuel flow of the nozzle in operation.
Figure 7:
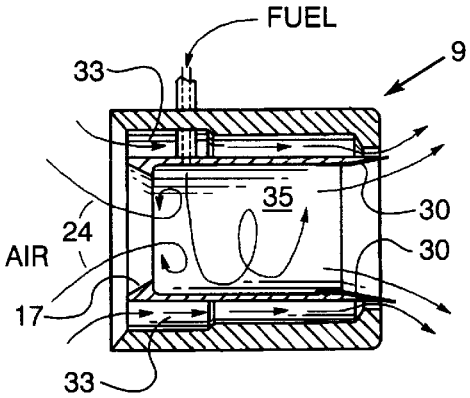
FIG. 7 is a longitudinal cross-sectional view of the atomizing nozzle of the invention taken along line 7—7 of FIG. 2, also showing air and fuel flow of the nozzle in operation.

The operation of the nozzle 9 is illustrated by FIGS. 6 and 7.

Referring first to FIG. 6, two main air paths are provided. The first is a central air path 32 passing through the interior of venturi 10. The second air path is through the four openings 33 between the four sides of retainer head 16 and the cylindrical interior of barrel 11. As indicated, fuel enters via catheter 12 tangentially with the cylindrical interior of venturi 10 at a relatively high velocity which causes the fuel to spin or swirl rotationally about the cylindrical interior surface of venturi 10, the centrifugal forces of the spinning fuel causing the fuel to spread out into a thin film upon the cylindrical surface as it is urged toward the exhaust end of the venturi by the air blast passing through the central opening 32.

As shown in FIG. 7 the central air blast 34 entering the interior of venturi 10 under the influence of the vena contracta formed by the annular ridge 17 forms a recirculation torus 35 immediately downstream of the ridge 17. The injected fuel is spread and sheared by the torus 35 into a fine spray that swirls about the interior of the venturi as it moves downstream, its centrifugal forces causing the fuel spray to be deposited upon the cylindrical prefilming surface. As this film 30 leaves the exhaust end of the nozzle 9 it is exposed on both sides to the fast-moving air blasts flowing through paths 32 and 33. The result is an efficient and thorough atomization of the injected fuel.

A pressure drop is induced by viscous drag in the catheter tube. This pressure drop can be adjusted by varying the length and diameter of the catheter and ensures an even distribution of fuel to all nozzles in the engine and reduces sensitivity to gravity which may tend to cause more fuel to flow through the bottom nozzles. Employing viscous drag rather than a restriction in the fuel line to achieve pressure drop also reduces sensitivity to particulate contamination since the minimum fuel passage size is much greater. The catheter guide tube 13 serves as a heat shield to prevent coking of the fuel at high temperatures. In addition, the catheter 12 is readily removable for cleaning.

Figure 8:
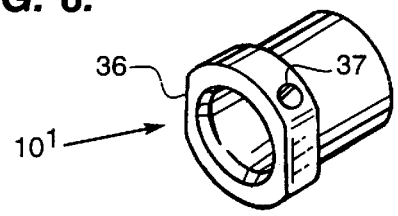
FIG. 8 is a perspective view of an alternate configuration of the central element of the invention.

FIG. 8 illustrates a second embodiment 10' of the venturi 10 in which the square retainer head of the venturi 10 is modified by forming two opposite sides of the head to mate with the cylindrical interior surface of the barrel into which the venturi is installed. This embodiment is preferred for miniature nozzles because it provides a longer path through retainer head 36 of the venturi for the catheter bore 37.

An efficient, effective, and readily manufacturable and inexpensive atomizing nozzle is thus provided in accordance with the stated objects of the invention, and although but a single embodiment of the invention together with a minor modification thereof has been illustrated and described it will be apparent to those skilled in the art that various changes and modifications may be made therein without departing from the spirit of the invention or from the scope of the appended claims.

What is claimed is:

1. A nozzle of an engine for atomizing liquid fuels prior to combustion, said nozzle comprising:

a cylindrical hollow tube forming a venturi having inlet and outlet ends;

a cylindrical hollow barrel; and a fuel catheter having a guide tube;

said fuel catheter having a pressure drop induced in said catheter by means of viscous drag which drop can be adjusted by varying the length and diameter of said catheter;

said venturi having a retainer head and a vena contracta at its inlet end, said vena contracts being formed by an inwardly extending annular ridge at said inlet end of said venturi, said retainer head extendable into and longitudinally of said venturi approximately one third the total length of said venturi, said barrel being approximately equal in length to that of said venturi and having a first internal diameter greater than the lateral dimension of said retainer head and a second internal diameter smaller than said first internal diameter, said first diameter extending from the inlet end of said barrel a distance approximately equal to the longitudinal dimension of said retainer head, said second internal dimension extending the remainder of the distance into said exhaust end of said barrel, a support shoulder being formed at the junction of said first and second diameters, and said barrel being flared inwardly a short distance at its exhaust end;

said venturi being insertable into the inlet end of said barrel until said retainer head of said venturi rest against the shoulder formed by the function between said first and said second internal diameters of said barrel, whereby when said venturi is installed inside said barrel two air paths are formed with the first air path extending from said inlet end of said venturi through the hollow interior of said venturi and said second air path extending from said inlet end to said exhaust end and through the spaces between said retainer head of said venturi and the inside cylindrical surface of said barrel, and through the space between the outside circumference of the remainder of said venturi and the inside diameter of the remainder of said barrel and exiting through the opening between the outer circumference of said venturi and the inside circumference of said inwardly flared end of said barrel; and said fuel catheter and guide tube extending laterally through aligned bores in said barrel and in said retainer head of said venturi, positioned and directed so that when said fuel catheter is inserted into said guide tube it enters said venturi tangentially to the inner cylindrical surface of said venturi;

whereby when air is supplied at an appropriate pressure at the inlet end of said nozzle and when liquid fuel is supplied to said fuel catheter, said air passes at high velocity through said first and said second air paths, the air that flows through said first air path forming a recirculation torus as it passes through said vena contracta of said venturi.

2. The nozzle set forth in claim 1 wherein the fuel enters tangentially into the inside cylindrical surface of said venturi and into said recirculation torus, said recirculation torus causing said fuel to be broken up into minute droplets which by virtue of said tangential entry take a swirling path as they are carried by the airstream toward the exhaust end of said nozzle;

the centrifugal forces of said swirling flow pattern causing said fuel droplets to be deposited upon the inside cylindrical surface of said venturi, forming a thin film of fuel thereupon, with atomization occurring as the film is exposed to the passing air stream of said first air path and as the remaining film leaves the exhaust end of said nozzle it is exposed to air on both sides with exposure of one side of the film to air from said the first air path and with exposure of the other side of the film to the air from said second air path.

3. The nozzle set forth in claim 2 wherein said retainer head has a polygonal cross-section and projections of said retainer head comprise the corners of said cross-section.

4. The nozzle set forth in claim 2 wherein said retainer head has extensions on two opposite sides that terminate in partial cylindrical surfaces, which partial cylindrical surface having a diameter smaller than said first internal diameter of said barrel.

5. The nozzle set forth in claim 2 wherein said retainer head has extensions on two opposite sides that terminate in partial cylindrical surfaces, which partial cylindrical surfaces have a diameter just smaller than said first internal diameter of said barrel.

6. The nozzle set forth in claim 2 wherein the inside edge of the inlet end of said barrel is beveled.

7. The nozzle set forth in claim 2 wherein the inside edge of the exhaust end of said venturi is beveled.

* * * * *

UNITED STATES PATENT AND TRADEMARK OFFICE

CERTIFICATE OF CORRECTION

PATENT NO. : 6,095,436
DATED : August 1, 2000
INVENTOR(S) : Seegers et al.

It is certified that error appears in the above-identified patent and that said Letters Patent is hereby corrected as shown below:

Column 1,
Line 3, please add the following government license rights statement:
-- This invention was made with Government support under Contract DAAH01-98-C-R061 awarded by the U.S. Army Aviation and Missle Command. The Government has certain rights in the invention. --

Signed and Sealed this

Twenty-third Day of September, 2003

JAMES E. ROGAN
*Director of the United States Patent and Trademark Office*